United States Patent [19]

Bienaime

[11] Patent Number: 5,002,225

[45] Date of Patent: Mar. 26, 1991

[54] PACK MADE FROM BOARD OR A SIMILAR MATERIAL

[75] Inventor: Patrick Bienaime, Troissereux, France

[73] Assignee: Unilever Patent Holdings B.V., Rotterdam, Netherlands

[21] Appl. No.: 417,130

[22] Filed: Sep. 29, 1989

[30] Foreign Application Priority Data

Oct. 7, 1988 [FR] France ..... 88 13179

[51] Int. Cl.[5] ..... B65D 5/42

[52] U.S. Cl. ..... 229/198.2; 206/140

[58] Field of Search ..... 229/40, 198.2; 206/140, 206/427, 434

[56] References Cited

U.S. PATENT DOCUMENTS

| | | | |
|---|---|---|---|
| 2,867,320 | 1/1959 | Andre | 206/140 |
| 3,156,377 | 11/1964 | Wysocki | 206/140 |
| 3,189,215 | 6/1965 | Currie, Jr. | 206/140 |
| 3,257,066 | 6/1966 | Williams | 229/40 |
| 3,314,590 | 4/1967 | Tolaas | 206/140 |
| 3,570,746 | 3/1971 | Wood | 229/40 |
| 3,828,926 | 8/1974 | Rossi | 229/40 |
| 3,931,926 | 1/1976 | Bensen | 229/198.2 |
| 4,728,025 | 3/1988 | Oliff | 229/40 |
| 4,749,123 | 6/1988 | Ganz | 229/40 |
| 4,860,943 | 8/1989 | Cooper | 229/40 |

FOREIGN PATENT DOCUMENTS

| | | | |
|---|---|---|---|
| 2418158 | 9/1979 | France | 229/198.2 |

*Primary Examiner*—Gary E. Elkins

*Attorney, Agent, or Firm*—Cushman, Darby & Cushman

[57] ABSTRACT

Pack made from board for packaging a number of objects (60) which have at least one cavity (64) in their base area, the pack forming a wrap-around sleeve (20, 30, 40, 50) that surrounds the objects and has locking elements which project into the cavities. The locking element (100) has at least one flap (102) that is die-cut from the base panel (50) of the sleeve and has a central section (112), which is joined to the base panel (50) by a first folding line (104) and is at least approximately the same size as the cavity (64), as well as two side sections (114, 116) which are located on either side of the central section (112), which are joined to the same by two further folding lines (118, 120) that together with the first folding line (104) form an angle of preferably less than 90°, and the length (L) of which is greater than the height (M) of the central section, measured at right angles to the folding line (104).

10 Claims, 3 Drawing Sheets

Fig. 6.
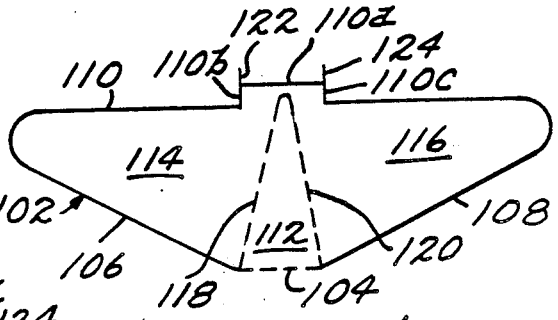
Fig. 7.
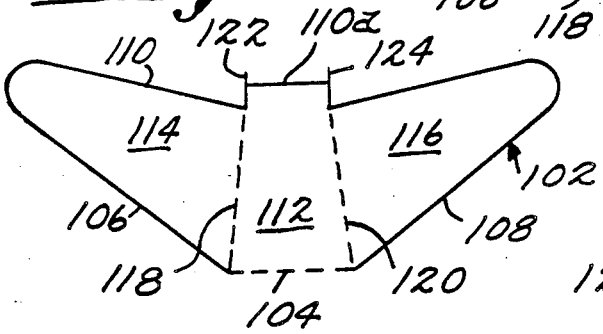
Fig. 7a.
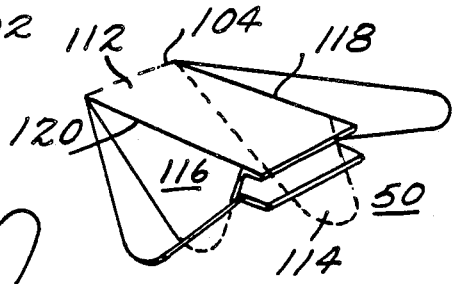
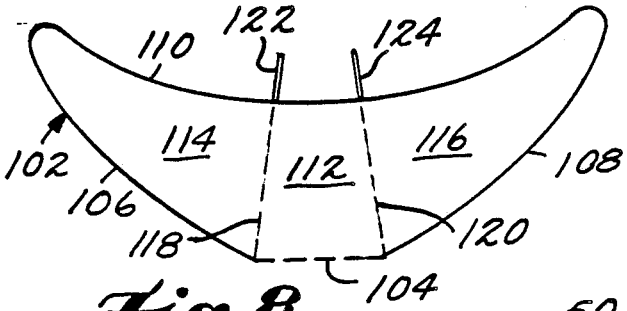
Fig. 8.
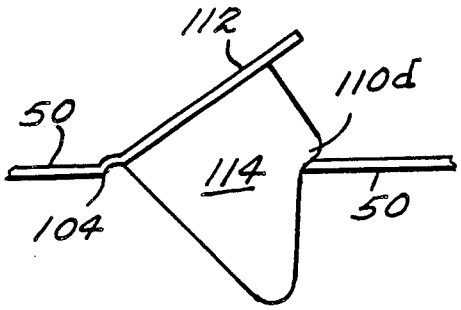
Fig. 9.
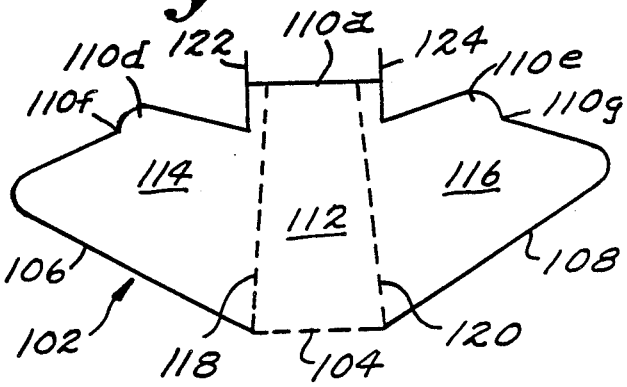
Fig. 9a.

PACK MADE FROM BOARD OR A SIMILAR MATERIAL

FIELD OF THE INVENTION

The invention relates to a pack made from board or a similar material for packaging a number of objects which have at least one cavity in their base area, the pack forming a wrap-around sleeve that surrounds the objects and has locking elements which project into the cavities.

BACKGROUND AND DESCRIPTION OF THE PRIOR ART

FR-A-2 550 515 discloses such a pack which has not, however, proved to be particularly effective.

The purpose of the invention is to create a pack of the kind outlined above, with which the packaged objects can be locked in place in a simple way.

SUMMARY OF THE INVENTION

In the solution to this problem proposed by the invention, the locking element has at least one flap that is die-cut from the base panel of the sleeve and has a central section, which is joined to the base panel by a first folding line and is at least approximately the same size as the cavity, as well as two side sections which are located on either side of the central section, which are joined to the same by two further folding lines that together with the first folding line form an angle of preferably less than 90°, and the length of which is greater than the height of the central section—measured at right angles to the folding line.

When the flap is designed in this way, the objects can be locked in place very simply, provided—as has already been explained—a cavity is available into which the flap can project.

It is also very advantageous if in accordance with the invention the base panel has cuts which extend from a cut line opposite the folding line.

These cuts make it easy for the side sections to pass through the base panel.

In a further advantageous feature of the invention, the cut line has a section opposite the folding line that is located further out, so that the central section projects beyond the side sections.

The flap locks even more effectively between the objects as a result.

It has also proved to be very advantageous if in accordance with the invention the two further folding lines each start at one end of the folding line and converge.

This on the one hand makes it easer to insert the flap in the cavity and on the other hand matches the shape of the flap more effectively to the shape of the objects.

In a further advantageous feature of the invention, the outline of the flap is formed by the first folding line, two first cut lines which are located on either side of the folding line at an angle to the same, and a second, largely straight cut line which joins the two outer ends of the first cut lines.

It is also very advantageous if in accordance with the invention the areas where the first cut lines and the second cut line meet are rounded off.

This makes sure that the flap does not get caught unintentionally when it is being inserted in the cavity.

In an advantageous further development of the invention, the second cut line extends inwards in the area of the two side sections and forms notches which the edge of the base section can engage in order to hold the flap in an intermediate position.

With a pack where the sleeve has at least one open side through which the objects that are to be packaged can be inserted, it is advantageous if the flap is positioned at least at a slight incline with respect to a horizontal surface (base panel), by folding along the first folding line.

In the case of a pack for a group of one or more rows of tub-like containers which are connected at their tops and between which cavities are provided in their base area, it has proved advisable for at least one flap to be provided in every row of containers.

It is also very advantageous if in accordance with the invention the first folding line of every flap runs at least approximately parallel to the longitudinal axis of the sleeve.

This means that the flaps are folded into position at right angles to the longitudinal axis of the rows of containers and hold the containers in place very securely.

Several embodiments of the invention are illustrated in the drawings.

BRIEF DESCRIPTION OF THE DRAWINGS

FIGS. 6, 7, 7*a*, 8, 9 and 9*a* show further flap designs.

DETAILED DESCRIPTION OF THE INVENTION

Figure 1:
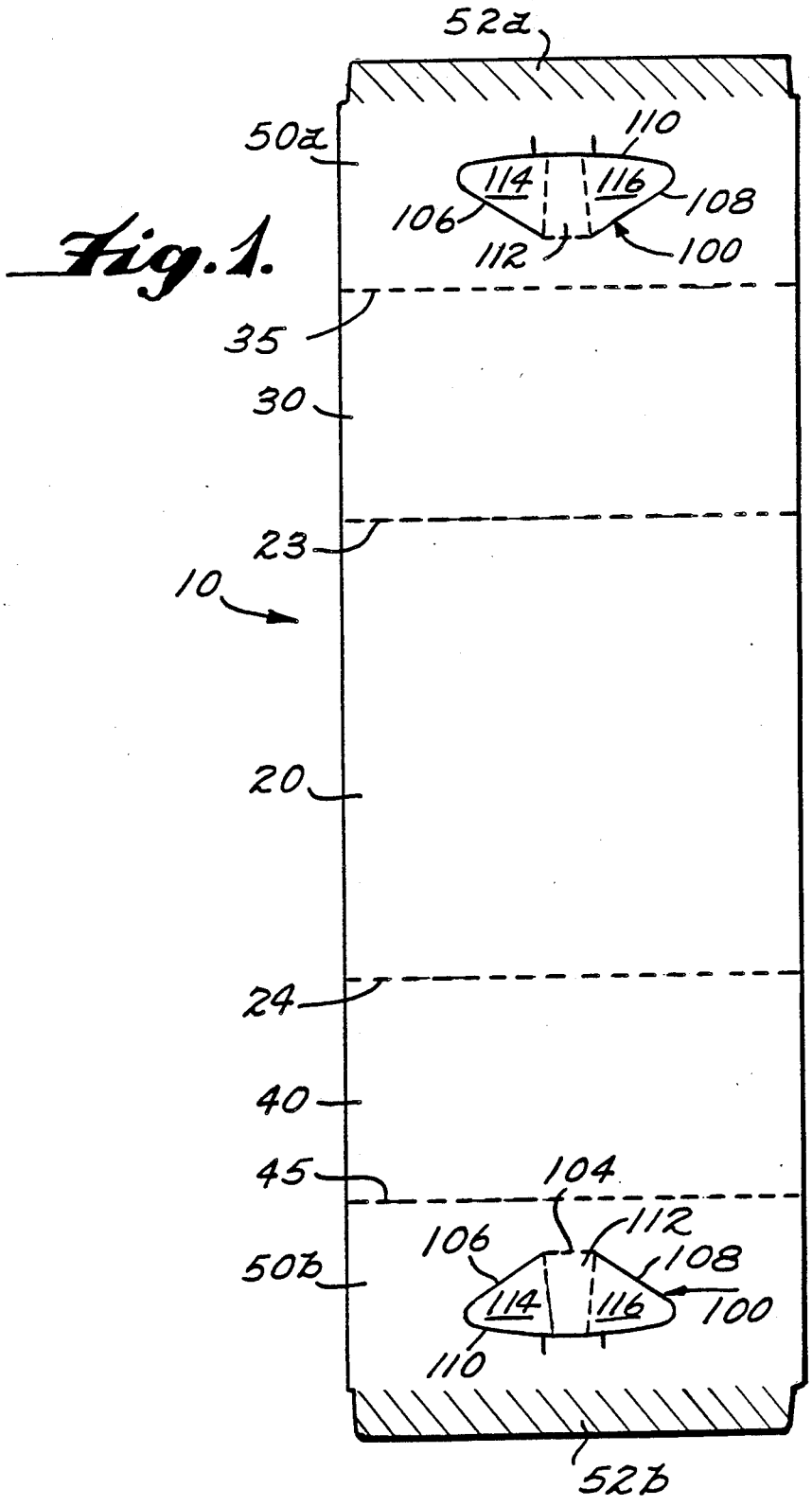
FIG. 1 shows a flat blank for the production of a pack.

FIG. 1 shows a flat board blank 10, which is used to produce a wrap-around pack and has a top panel 20, to which two side panels 30/40 are hinged along folding lines 23 and 24. Sections 50*a*, 50*b* of a base panel 50, which are joined together to form the base panel in the glued seam areas 52*a*, 52*b*, are joined to these side panels along further folding lines 35 and 45. Each of the two sections of the base panel 50 is provided with a locking element 100 / flap 102, which is die-cut from the base panel along cut lines 106, 108, 110 and is connected to the base panel along a folding line 104. This flap has a central section 112 and two side sections 114, 116, that are connected by folding lines 118 and 120, as can be seen in FIG. 4.

Figure 2:
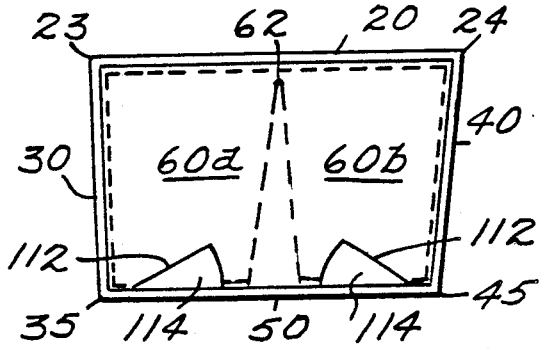
FIG. 2 shows a cross-section of a finished erected and filled pack.
Figure 3:
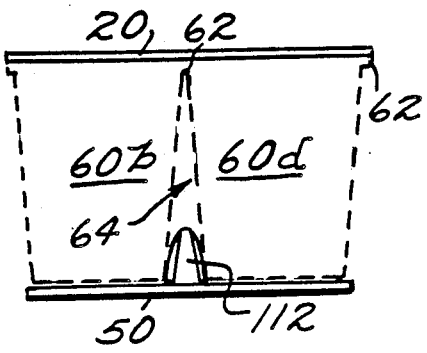
FIG. 3 shows a longitudinal section of the pack.

FIGS. 2 and 3 show two sections of finished, erected packs, that are filled with four tub-like containers 60*a*, 60*b*, 60*d*, which are arranged in two rows. The containers are connected at their top end along a rim 62 and have a cavity 64 between them, which is engaged by the flap 102 with its central section 112 and its side sections 114 and 116.

Figure 4:
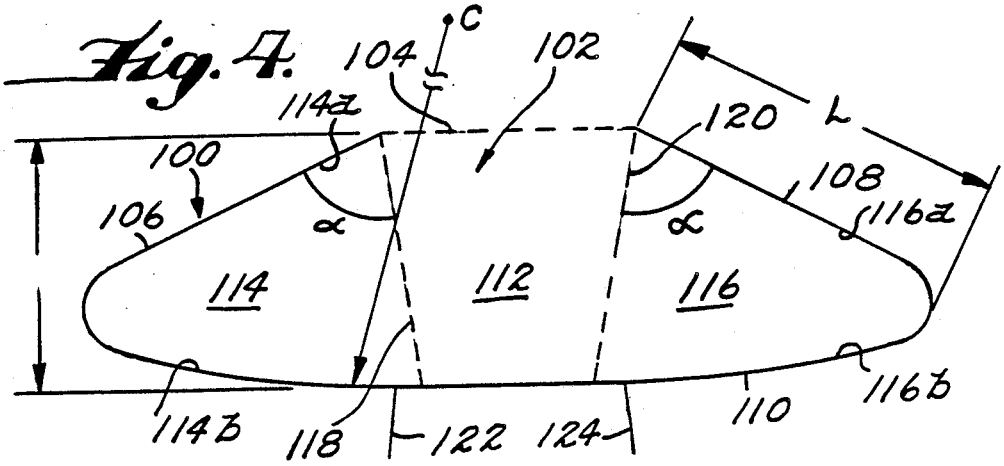
FIG. 4 shows a flap when it is flat.

As is shown in FIG. 4, the length L of the side sections 114 and 116 Of the flap 102 is greater than the height M of the central section 112, that gets narrower towards its free end opposite the folding line 104. To achieve this, the two folding lines 118, 120 that start at the ends of the folding line 104, converge and form an angle $\alpha$, which is slightly smaller than 90°, with the two cut lines 106 and 108.

The cut line 110 is slightly curved with a radius of curvature the centre of which is at a point C, which is outside the point P where the extensions to the cut lines 106 and 108 cross. In the drawings, the edges of the two side sections 114 and 116 that are formed by the cut lines are numbered 114*a*, 114*b* and 116*a*, 116*b*.

Figure 5:
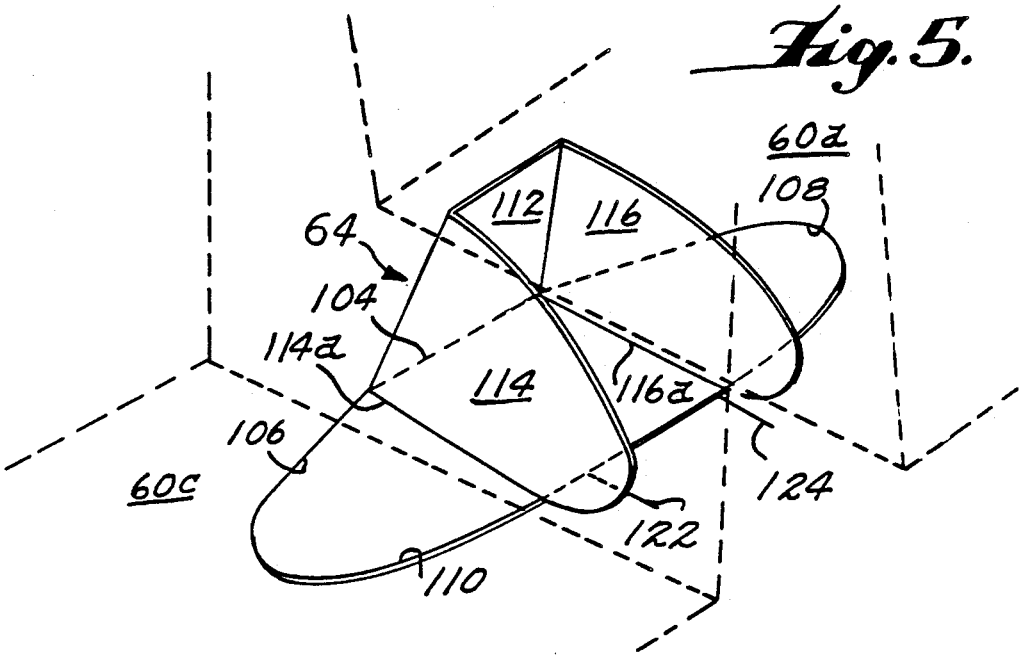
FIG. 5 shows an erected flap that has been folded inwards.

Two cuts 122 and 124, through which the rounded ends of the two side sections pass when the flap 102 is pressed into the cavity 64, extend almost at right angles from the cut line 110. This position of the flap 102 between two containers 60*a* and 60*c* is shown in FIG. 5, where the central section has been pressed inwards with the two side sections, while the ends of the side sections have already passed through the two cuts and rest on the adjacent surface of the base panel.

FIG. 6 shows a flap 102 with a central section that is almost triangular. In addition, a cut line 110*a*, which, like the cut line 110, is straight, is provided further out than the cut line 110 between the two cuts 122 and 124.

FIG. 7 shows a flap 102 of similar design where, however, the folding lines 118 and 120 run towards the two cuts.

FIG. 8, on the other hand, shows a flap in which the cut line 110 is curved, so that the side sections are crescent-shaped.

In contrast to this, the same cut line 110 in the embodiment shown in FIGS. 9 and 9*a* has a notch 110*f* and 110*g*, which is bordered by a projection 110*d* and 110*e*, in each of the two side sections.

The edge of the base panel 50 engages this notch and holds the flap in an intermediate position, as is shown in FIG. 9*a*.

I claim:

1. Pack, made from board material, for packaging a number of objects each having a top with a rim and a base and shaped so that when the rims of the tops are in contact the bases of adjacent objects will be separated to leave a cavity between the adjacent objects, said pack comprising a wrap around sleeve including a base panel, said sleeve including a locking element having one flap die cut from said base panel, said flap having a central section connected to said base panel by a first fold line and having a dimension that is at least approximately the width of the cavity and a selected height measured along a line extending perpendicular to said first fold line, said flap further including two side sections disposed on opposite sides of said central section and connected thereto along second and third fold lines, respectively, said second and third fold lines each forming an angle with said first fold line no greater than approximately 90°, each said side section having a length which is greater than said selected height of said central section.

2. Pack according to claim 1, wherein the base panel has cuts which extend from a cut line opposite said first fold line.

3. Pack according to claims 1, or 2, wherein the cut line has a section opposite said first fold line that is located farther out so that the central section projects beyond the side sections.

4. The pack according to claims 1, or 2, wherein said second and third fold lines each start at one end of said first fold line and converge.

5. Pack according to claim 1, wherein said flap has a periphery defined by said first folding line and two first cut lines located each on either side of said first folding line and extending at an angle thereto and a second straight cut line extending between the ends of said two first cut lines.

6. The pack as claimed in claim 5, wherein the intersection of said first two cut lines and said second straight cut lines are rounded off.

7. Pack according to claim 5, wherein said second cut line has a first portion extending along one of said side sections and a second portion extending along the other said side section with said two portions extending inwardly toward said central section to intercept said respective second and third fold lines to define a notch engageable by an edge of said base panel.

8. Pack according to claim 1, wherein said pack has one open side through which objects that are to be packaged can be inserted with said flap being positioned at a slight incline relative to said base panel.

9. Pack according to claim 8, wherein said objects are tub-like containers which are joined together at adjacent rims thereof, and wherein at least one flap is provided between adjacent containers.

10. Pack according to claim 9, wherein said sleeve has a longitudinal axis and said first fold line of every flap extends at least approximately parallel to said longitudinal axis.

* * * * *